US010648285B2

(12) United States Patent
Gaudette et al.

(10) Patent No.: US 10,648,285 B2
(45) Date of Patent: May 12, 2020

(54) FRACTURING SYSTEM AND METHOD

(71) Applicants: Sean Gaudette, Katy, TX (US); Jonathan Nicholas Croy, Katy, TX (US)

(72) Inventors: Sean Gaudette, Katy, TX (US); Jonathan Nicholas Croy, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/983,534

(22) Filed: May 18, 2018

(65) Prior Publication Data

US 2019/0353005 A1 Nov. 21, 2019

(51) Int. Cl.

| | |
|---|---|
| ***E21B 34/10*** | (2006.01) |
| ***E21B 43/26*** | (2006.01) |
| ***E21B 43/08*** | (2006.01) |
| ***E21B 34/00*** | (2006.01) |

(52) U.S. Cl.

CPC ..... *E21B 34/10* (2013.01); *E21B 43/08* (2013.01); *E21B 43/26* (2013.01); *E21B 2034/007* (2013.01)

(58) Field of Classification Search

CPC ..... E21B 34/10; E21B 34/14; E21B 43/08; E21B 43/26; E21B 2034/007

See application file for complete search history.

(56) References Cited

U.S. PATENT DOCUMENTS

| | | | | |
|---|---|---|---|---|
| 8,800,661 | B2 | 8/2014 | Madero et al. | |
| 9,523,261 | B2 | 12/2016 | Flores et al. | |
| 2008/0135255 | A1* | 6/2008 | Coronado | E21B 34/102 166/323 |
| 2014/0262324 | A1 | 9/2014 | Greci et al. | |
| 2015/0021026 | A1 | 1/2015 | Giroux | |
| 2016/0108711 | A1* | 4/2016 | Lynk | E21B 43/26 166/297 |
| 2018/0094508 | A1 | 4/2018 | Smith et al. | |

FOREIGN PATENT DOCUMENTS

| | | | | |
|---|---|---|---|---|
| WO | WO-2017041105 | A1 * | 3/2017 | E21B 34/14 |

OTHER PUBLICATIONS

Notification of Transmittal of the International Search Report and the Written Opinion of the International Searching Authority, or the Declaration; PCT/US219/026874; dated Jul. 26, 2019; 8 total pages.

* cited by examiner

*Primary Examiner* — James G Sayre
(74) *Attorney, Agent, or Firm* — Cantor Colburn LLP

(57) ABSTRACT

A fracturing system includes a fracturing sleeve having an opening sleeve and a closing sleeve. The closing sleeve has a collapsible seat. The system also includes a sand screen spaced from the fracturing sleeve and disposed in a same zone as the frac sleeve. The screen includes a screen sleeve having a collapsible seat, the screen seat being complementary to a plug that is complementary to the closing sleeve collapsible seat.

12 Claims, 3 Drawing Sheets

FRACTURING SYSTEM AND METHOD

BACKGROUND

In the resource recovery industry, fracturing operations have become increasingly important to the maximization of recovered resources, for example hydrocarbons. Fracturing generally requires the isolation of a zone of a borehole and application of high pressure fluid to the formation in which that borehole is drilled through a fracturing port of a borehole tubular. Dropping plugs, one after another into sleeves that have seats dimensioned to receive particular ones of the plugs is often used as a mechanism for building a system capable of fracturing multiple zones with efficiency. While efficiency gains are obtained in this manner, it still lags behind efficiency ratios required to maximize profitability in a resource recovery operation. The art then will well receive alternative systems and methods that further improve efficiency and profitability.

SUMMARY

A fracturing system including a fracturing sleeve having an opening sleeve and a closing sleeve, the closing sleeve having a collapsible seat; a sand screen spaced from the fracturing sleeve and disposed in a same zone as the frac sleeve, the screen including a screen sleeve having a collapsible seat, the screen seat complementary to a plug that is complementary to the closing sleeve collapsible seat.

A method for fracturing including running a plug to an opening sleeve of a fracturing system as discussed in the paragraph immediately above; fracturing a formation through the fracturing system; running a second plug; shifting with the second plug the screen sleeve; and shifting with the second plug the closing sleeve.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
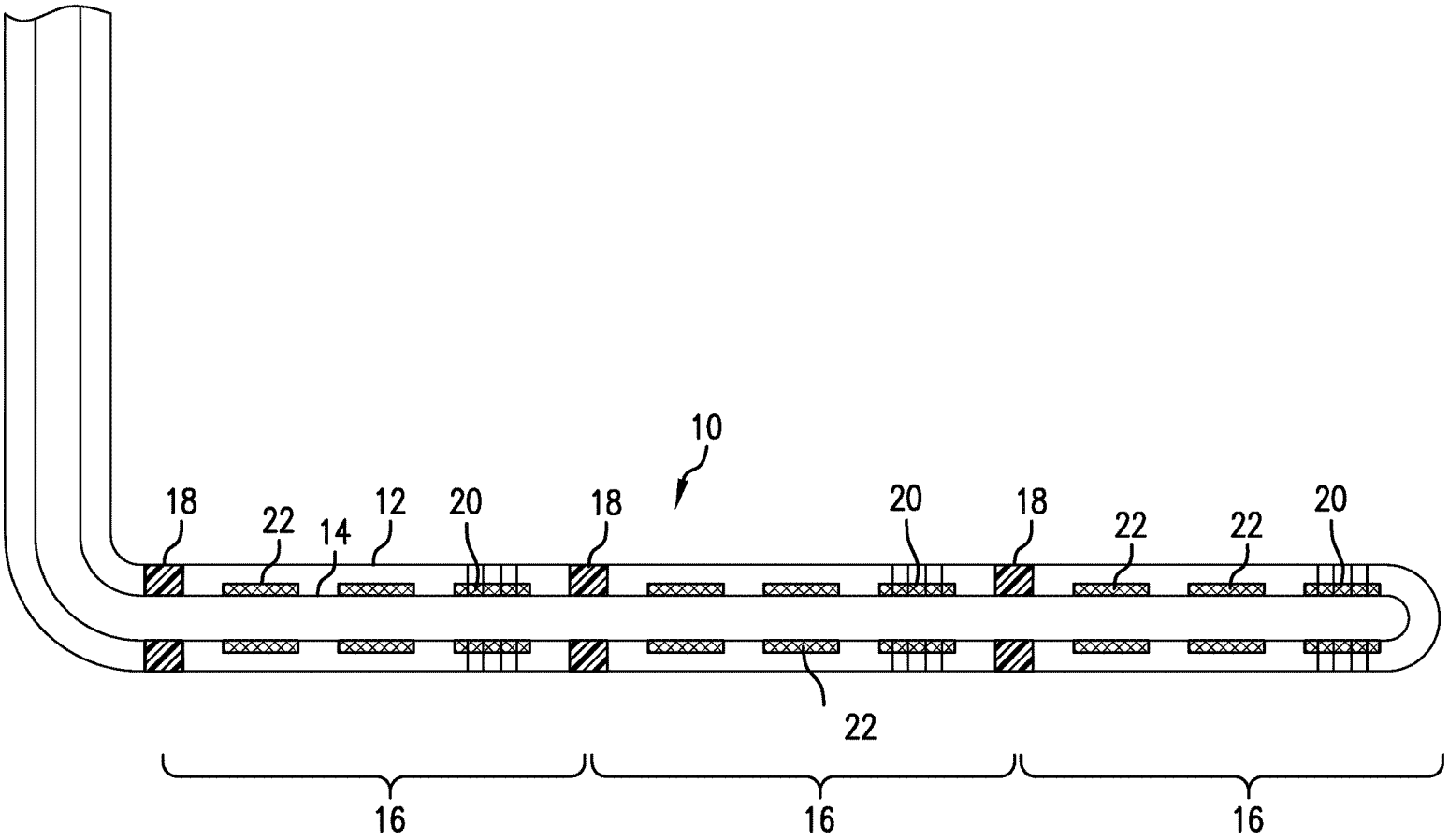
FIG. 1 is a schematic cross section view of a borehole having a fracturing system therein according to a teaching hereof.

Referring to FIG. 1, a fracturing system 10 is illustrated in a borehole 12. The system includes a tubular string 14 having three illustrated zones 16 (more or fewer are contemplated). The zones 16 are separated by isolation devices such as packers 18. Each zone 16 includes a fracture sleeve 20 and a sand screen 22. In embodiments, more than one screen is employed in a given zone 16. As illustrated, two sand screens 22 are present in each zone 16 though is it also to be understood that there is no intention to limit the number of screens to two. Rather any number of screens 22 may be employed limited only by the space between adjacent zonal isolators 18.

Figure 2A:
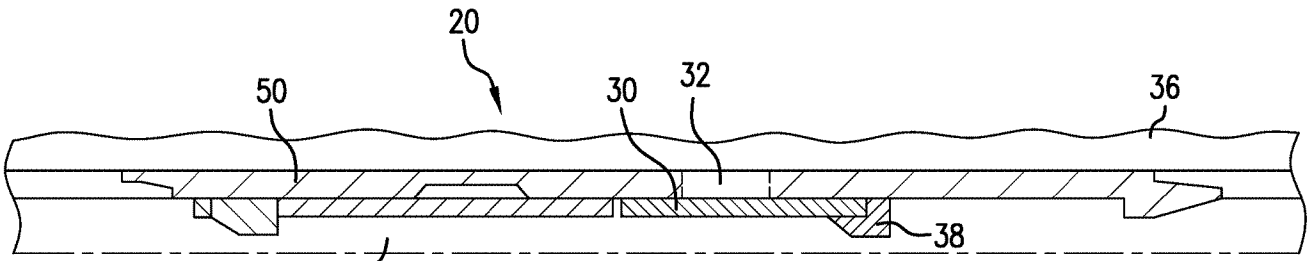
FIGS. 2*a*-2*c* are sequential quarter section views of a fracture sleeve in the run-in, fracture and production positions.
Figure 2B:
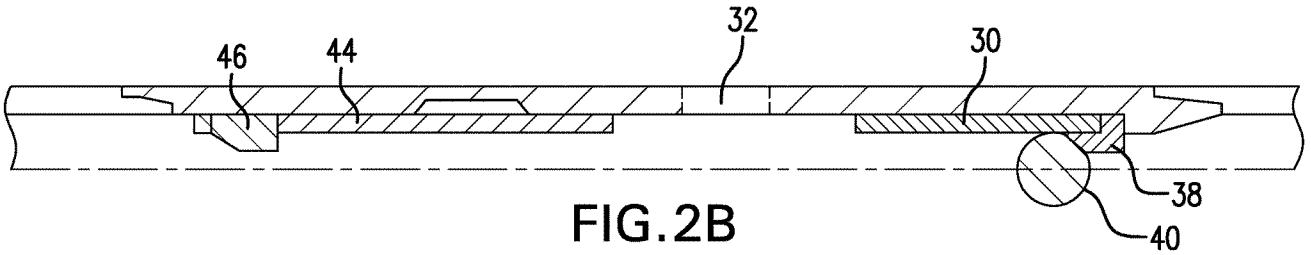
Figure 2C:
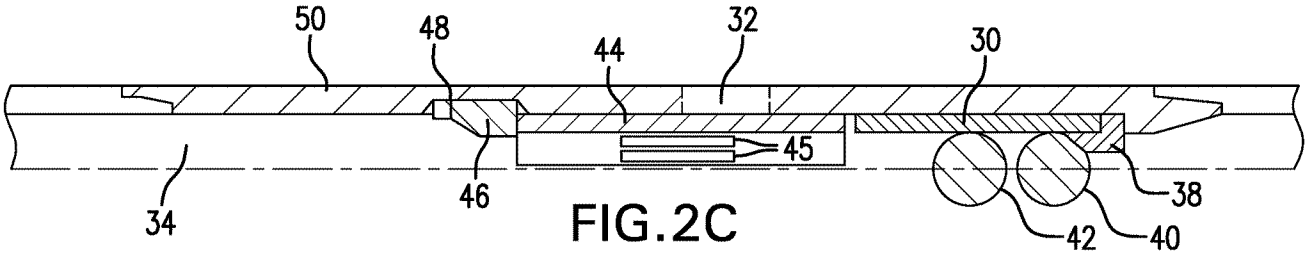

Referring to FIGS. 2*a*-2*c*, a sequence of positions for the fracturing sleeve 20 are illustrated. In FIG. 2*a*, the fracturing sleeve 20 is in a run in position with an opening sleeve 30 covering a fracturing port 32. In this position, fluid from an ID 34 of the string 14 is precluded from flowing through the fracturing port 32 toward a formation 36. It is noted that the opening sleeve 30 includes a seat 38 thereon such that a ball or plug 40 (see FIG. 2*b*) may drive the opening sleeve 30 to an open position. While the seat is illustrated as located at a downhole end of the opening sleeve 30, the seat could easily be moved to the uphole end of opening sleeve 30 or anywhere in between, as desired.

Referring to FIG. 2*b*, the sleeve 20 is illustrated in a fracture position with the opening sleeve 30 open and revealing the port 32 thereby fluidly communicating the ID 34 of the tubular 14 to the formation 36 through the port 32. In this position, fluid pressure applied through the ID 34 can be applied to the formation 36 as the ball or plug 40 is on seat 38 and blocking the ID 34 of the tubular 14 downhole of the plug 40. Applied pressure, generally from surface, will fracture the formation after which another ball or plug 42 of another size, a larger size than ball 40, is deployed to shift a closing sleeve 44 from a position not aligned with the port 32 to a position aligned with the port 32 thereby closing the same. The closing sleeve 44 further includes a collapsible seat 46. When the second ball or plug 42 lands in seat 46, the closing sleeve 44 is shifted closed. Simultaneously, the collapsible seat 46 will become aligned with a recess 48 in housing 50 and collapse radially outwardly sufficiently to allow ball 42 to pass. This position is visible in FIG. 2*c*. In an embodiment, the closing sleeve 44 is fluid permeable so that fluid may be produced through the closing sleeve but frac proppant will not flow therethrough once closed. This may be occasioned by configuring the closing sleeve as a screen or by configuring the closing sleeve 44 with, having radial openings 45 that may be of any geometry including slots.

It will be appreciated from the illustration in FIG. 2*c* that both balls 40 and 42 are in this condition free to move uphole for removal or to simply allow more fluid flow contact with the balls 40 and 42 to enhance their rate of dissolution if indeed the particular balls or plugs employed are of the degradable or dissolvable type.

Figure 3A:
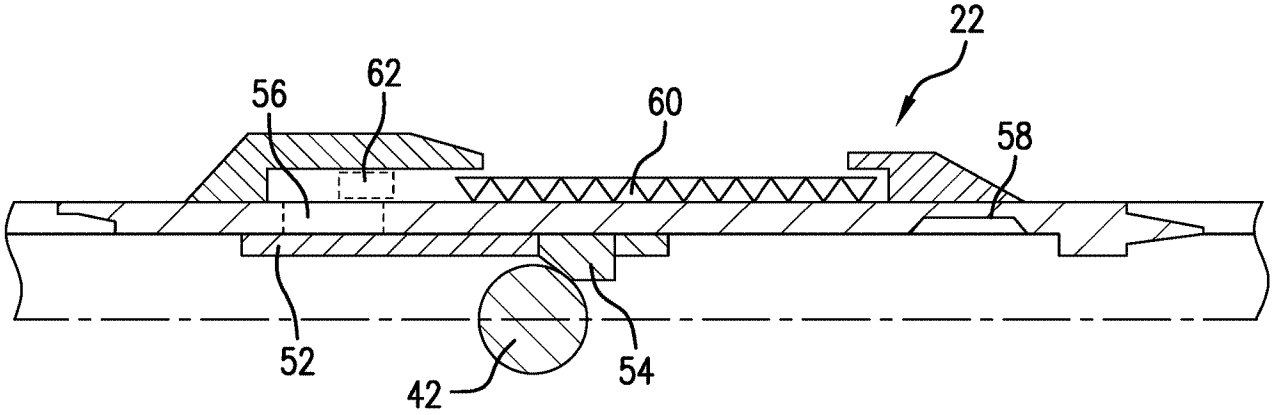
FIG. 3*a*-3*b* are sequential quarter section views of a screen employed with the fracture sleeve shown in FIGS. 2*a*-2*c*.
Figure 3B:
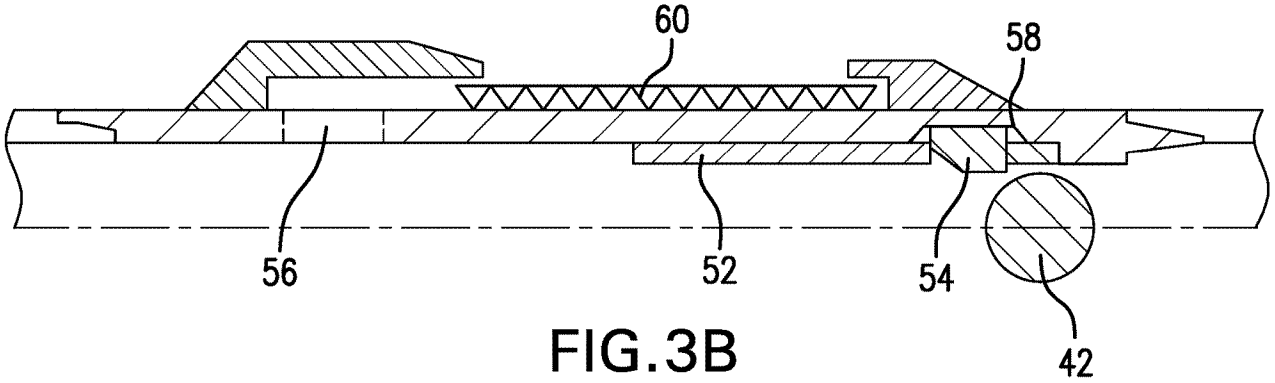

It will be noted that ball or plug 42 will have, prior to actuating the closing sleeve 44 already actuated one of more sand screen sleeves illustrated in FIGS. 3*a*-3*b*. That is to say that the fracturing system includes one or more sand screens 22 as noted in FIG. 1 as well as the fracturing sleeve 20. While ball or plug 40 will move through the sand screens 22 and the closing sleeve 44 without causing actuation of any of them but rather only actuate the opening sleeve 30, the ball or plug 42 will actuate each sand screen 22 as it passes and finally land in the seat 46 to actuate closing sleeve 44.

Referring to FIGS. 3*a* and 3*b*, a sand screen 22 includes a screen sleeve 52 having a collapsible seat 54 associated therewith and disposed for run in and the pressure cycle of a fracturing operation over a production port 56. The sand screen 22 is opened to flow by the passing of ball or plug 42, which is then released when the collapsible seat 54 reaches screen recess 58 and collapses thereinto. The plug 42 is then free to continue on to the next sand screen 22 or the closing sleeve 44.

Still referring to FIGS. 3*a* and 3*b*, the sand screens 22 include filtration material 60 that may be a conventional screen or any other type of filtration material such as a bead pack, a shape memory filtration material, etc. It is notable that a conventional screen may be employed in the system described herein since such screens normally would be damaged by the surge that occurs immediately after opening of the screens to production flow. As taught herein however, the number of screens spaced from the fracture sleeve 20 provide additional flow area and dissipate the surge pressure better than prior art systems making this system capable of using the less expensive conventional screens. More surge resistant filtration material can of course be used with the system as well.

It is also contemplated to dispose an inflow control device 62 between the production port 56 and the screen 60 to further protect the filtration material 60 from surge pressures.

Finally, it is noted that the system disclosed herein can be repeated for as many zones as exist in a borehole.

Set forth below are some embodiments of the foregoing disclosure:

Embodiment 1

A fracturing system including a fracturing sleeve having an opening sleeve and a closing sleeve, the closing sleeve having a collapsible seat; a sand screen spaced from the fracturing sleeve and disposed in a same zone as the frac sleeve, the screen including a screen sleeve having a collapsible seat, the screen seat complementary to a plug that is complementary to the closing sleeve collapsible seat.

Embodiment 2

The fracturing system as in any prior embodiment wherein the closing sleeve is fluid permeable.

Embodiment 3

The fracturing system as in any prior embodiment wherein the closing sleeve includes radial openings.

Embodiment 4

The fracturing system as in any prior embodiment wherein the closing sleeve includes radial slots.

Embodiment 5

The fracturing system as in any prior embodiment wherein the sand screen is a number of spaced apart sand screens.

Embodiment 6

The fracturing system as in any prior embodiment wherein the spaced apart sand screens are all actuable by a same plug.

Embodiment 7

The fracturing system as in any prior embodiment wherein the sand screen includes a surge protector.

Embodiment 8

The fracturing system as in any prior embodiment wherein the surge protector is an inflow control device.

Embodiment 9

The fracturing system as in any prior embodiment wherein the opening sleeve and the closing sleeve are actuable by distinct plugs, at least one of which is not complementary to one of the opening sleeve and the closing sleeve.

Embodiment 10

A method for fracturing including running a plug to an opening sleeve of a fracturing system as in any prior embodiment; fracturing a formation through the fracturing system; running a second plug; shifting with the second plug the screen sleeve; and shifting with the second plug the closing sleeve.

Embodiment 11

The method as in any prior embodiment wherein the shifting of the screen sleeve includes collapsing the seat of the screen sleeve.

Embodiment 12

The method as in any prior embodiment wherein the shifting of the closing sleeve includes collapsing the seat of the closing sleeve.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A fracturing system comprising:

a fracturing sleeve having an opening sleeve and a closing sleeve, the closing sleeve having a collapsible seat;

a sand screen spaced from the fracturing sleeve and disposed in a same zone as the frac sleeve, the screen including a screen sleeve having a collapsible seat, the screen seat complementary to a plug that is complementary to the closing sleeve collapsible seat.

2. The fracturing system as claimed in claim 1 wherein the closing sleeve is fluid permeable.

3. The fracturing system as claimed in claim 1 wherein the closing sleeve comprises radial openings.

4. The fracturing system as claimed in claim 1 wherein the closing sleeve comprises radial slots.

5. The fracturing system as claimed in claim 1 wherein the sand screen is a number of spaced apart sand screens.

6. The fracturing system as claimed in claim 5 wherein the spaced apart sand screens are all actuable by a same plug.

7. The fracturing system as claimed in claim 1 wherein the sand screen includes a surge protector.

8. The fracturing system as claimed in claim 7 wherein the surge protector is an inflow control device.

9. The fracturing system as claimed in claim 1 wherein the opening sleeve and the closing sleeve are actuable by distinct plugs, at least one of which is not complementary to one of the opening sleeve and the closing sleeve.

10. A method for fracturing comprising:

running a plug to an opening sleeve of a fracturing system as claimed in claim 1;

fracturing a formation through the fracturing system;

running a second plug;

shifting with the second plug the screen sleeve; and shifting with the second plug the closing sleeve.

11. The method as claimed in claim 10 wherein the shifting of the screen sleeve includes collapsing the seat of the screen sleeve.

12. The method as claimed in claim 10 wherein the shifting of the closing sleeve includes collapsing the seat of the closing sleeve.

* * * * *